US010379491B1

(12) United States Patent
Wu

(10) Patent No.: US 10,379,491 B1
(45) Date of Patent: Aug. 13, 2019

(54) LATERAL CAP OF PROCESS CARTRIDGE

(71) Applicant: GENERAL PLASTIC INDUSTRIAL CO., LTD., Taichung (TW)

(72) Inventor: Yi-Chia Wu, Taichung (TW)

(73) Assignee: GENERAL PLASTIC INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 15/963,534

(22) Filed: Apr. 26, 2018

(30) Foreign Application Priority Data

Mar. 13, 2018 (TW) ..... 107203240 U

(51) Int. Cl.
*G03G 21/00* (2006.01)
*G03G 21/18* (2006.01)

(52) U.S. Cl.
CPC ... *G03G 21/186* (2013.01); *G03G 2221/1657* (2013.01)

(58) Field of Classification Search
CPC ..... G03G 21/186; G03G 2221/1657
USPC ..... 399/116, 167
See application file for complete search history.

(56) References Cited

U.S. PATENT DOCUMENTS

2008/0152388 A1* 6/2008 Ueno ..... G03G 15/757 399/167
2011/0038649 A1* 2/2011 Miyabe ..... G03G 15/0896 399/119
2012/0294649 A1* 11/2012 Kikuchi ..... G03G 15/757 399/117
2014/0270845 A1* 9/2014 Kawakami ..... G03G 21/186 399/110
2016/0018777 A1* 1/2016 Iijima ..... G03G 15/757 399/111
2016/0259295 A1* 9/2016 Morgan ..... G03G 21/181
2017/0146951 A1* 5/2017 Yan ..... G03G 21/186
2017/0261919 A1* 9/2017 Huang ..... G03G 15/757

FOREIGN PATENT DOCUMENTS

CN 204374619 6/2015

* cited by examiner

*Primary Examiner* — Robert B Beatty
(74) *Attorney, Agent, or Firm* — Muncy, Geissler, Olds & Lowe, P.C.

(57) ABSTRACT

A lateral cap of a process cartridge includes a main body, a through hole, a flange and a guiding portion. The main body has a first side for being disposed to a housing of a process cartridge, and a second side opposite to the first side. The through hole penetrates through the first and second sides. The flange extends from the second side of the main body toward a direction away from the first side. The guiding portion extends from the flange toward an axis direction of the through hole. The lateral cap guides a rotational force receiving member to a desired position and can guide the rotational force receiving member to move toward a driving head to make them firmly coupled with each other when the rotational force receiving member is moved from a biased position to a coaxial position in alignment with the driving head.

5 Claims, 11 Drawing Sheets

LATERAL CAP OF PROCESS CARTRIDGE

BACKGROUND OF THE INVENTION

1. Field of the Invention

The present invention relates generally to an electronic image-forming apparatus and more particularly, to a lateral cap of a process cartridge.

2. Description of the Related Art

A conventional electronic image-forming apparatus, such as photocopier or printer, is generally equipped with a replaceable process cartridge therein. Inside the housing of the process cartridge, a plurality of rollers, such as photosensitive roller, developer roller, etc., are installed. An end of the roller is connected with an end member, such that the end member and the roller can synchronously rotate. The end member is further connected with a rotational force receiving member, which protrudes outside the housing and is engageable with a driving head provided inside the electronic image-forming apparatus. As a result, when the driving head rotates, the roller is driven by the end member via the rotational force receiving member to rotate relative to the housing of the process cartridge so as to perform a developing or photosensitive work.

In a task of installing the process cartridge into the electronic image-forming apparatus, in order to engage the rotational force receiving member with the driving head, the rotational force receiving member will be restricted to a biased position in advance, and then when the rotational force receiving member is in contact with the driving head, the rotational force receiving member gradually returns back to a coaxial position in coaxial alignment with the driving head. After the process cartridge is positively installed into the electronic image-forming apparatus at a target position, the driving head, the rotational force receiving member, the end member and the roller are aligned in a line and rotatable synchronously. The conventional structure that can achieve the aforesaid function is quite complicated. Therefore, designing a simple and compact structure that can make the rotational force receiving member be positively and firmly coupled with the driving head after the rotational force receiving member returns from the biased position back to its initial position is always a challenge to the manufacturers in this industry field.

SUMMARY OF THE INVENTION

The present invention has been accomplished in view of the above-noted circumstances. It is an objective of the present invention to provide a lateral cap of a process cartridge, which can guide the rotational force receiving member to move toward the driving head so as to make them firmly coupled with each other when the rotational force receiving member returns from a biased position back to a coaxial position in coaxial alignment with the driving head.

Another objective of the present invention is to provide a lateral cap of a process cartridge, which has a simple and compact structure and can guide and position the rotational force receiving member at a desired position positively.

To attain the above objectives, the present invention provides a lateral cap of a process cartridge, which is adapted to be disposed to a housing of the process cartridge. The process cartridge is adapted to be installed into an electronic image-forming apparatus along an installation direction. The lateral cap of the process cartridge comprises a main body, a through hole, a flange and a guiding portion. The main body includes a first side configured for being disposed to the housing of the process cartridge, and a second side opposite to the first side. The through hole penetrates from the first side through the second side. The flange extends from the second side toward a direction away from the first side. The guiding portion extends from the flange toward an axis direction of the through hole. As a result, the lateral cap has a simple and compact structure and can guide a rotational force receiving member to be positively positioned at a desired position. That is, the lateral cap can guide the rotational force receiving member to move toward a driving head to make them firmly coupled with each other when the rotational force receiving member is moved from a biased position to a coaxial position in alignment with the driving head.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
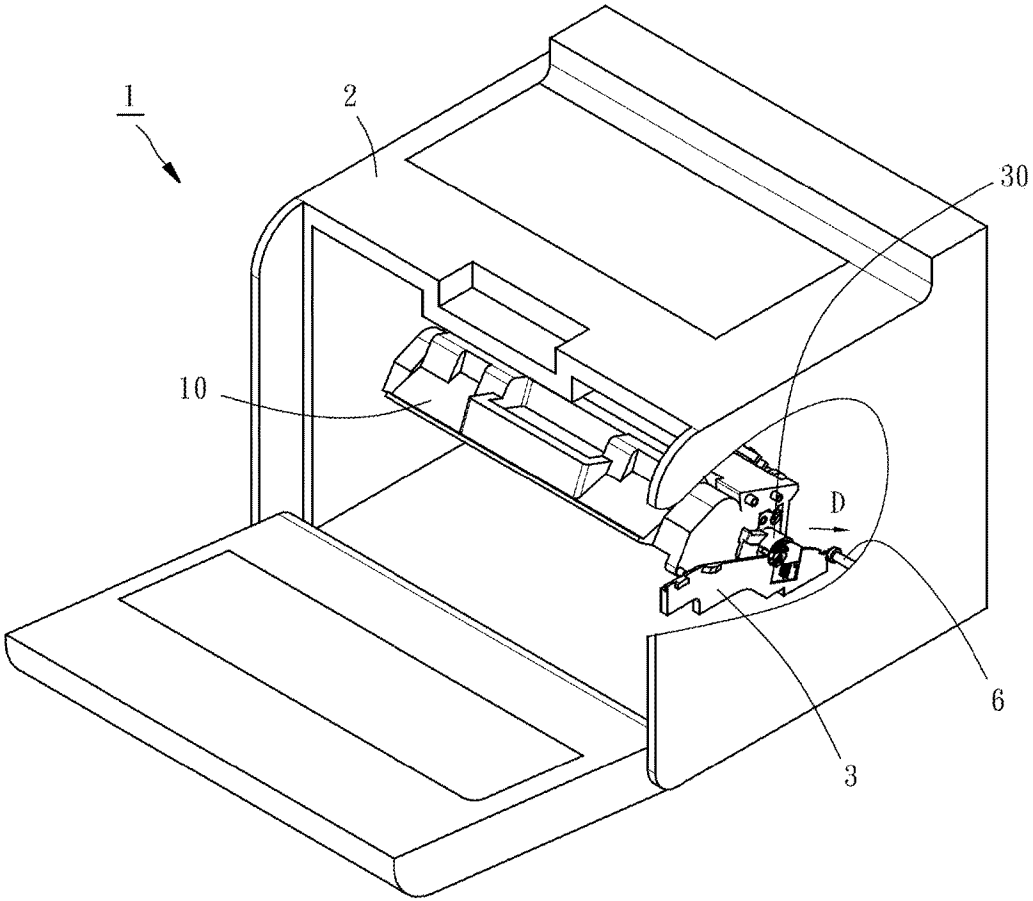
FIG. 1 is a schematically perspective view, showing that a lateral cap in accordance with a first embodiment of the present invention is disposed to a process cartridge of an electronic image-forming apparatus.
Figure 2:
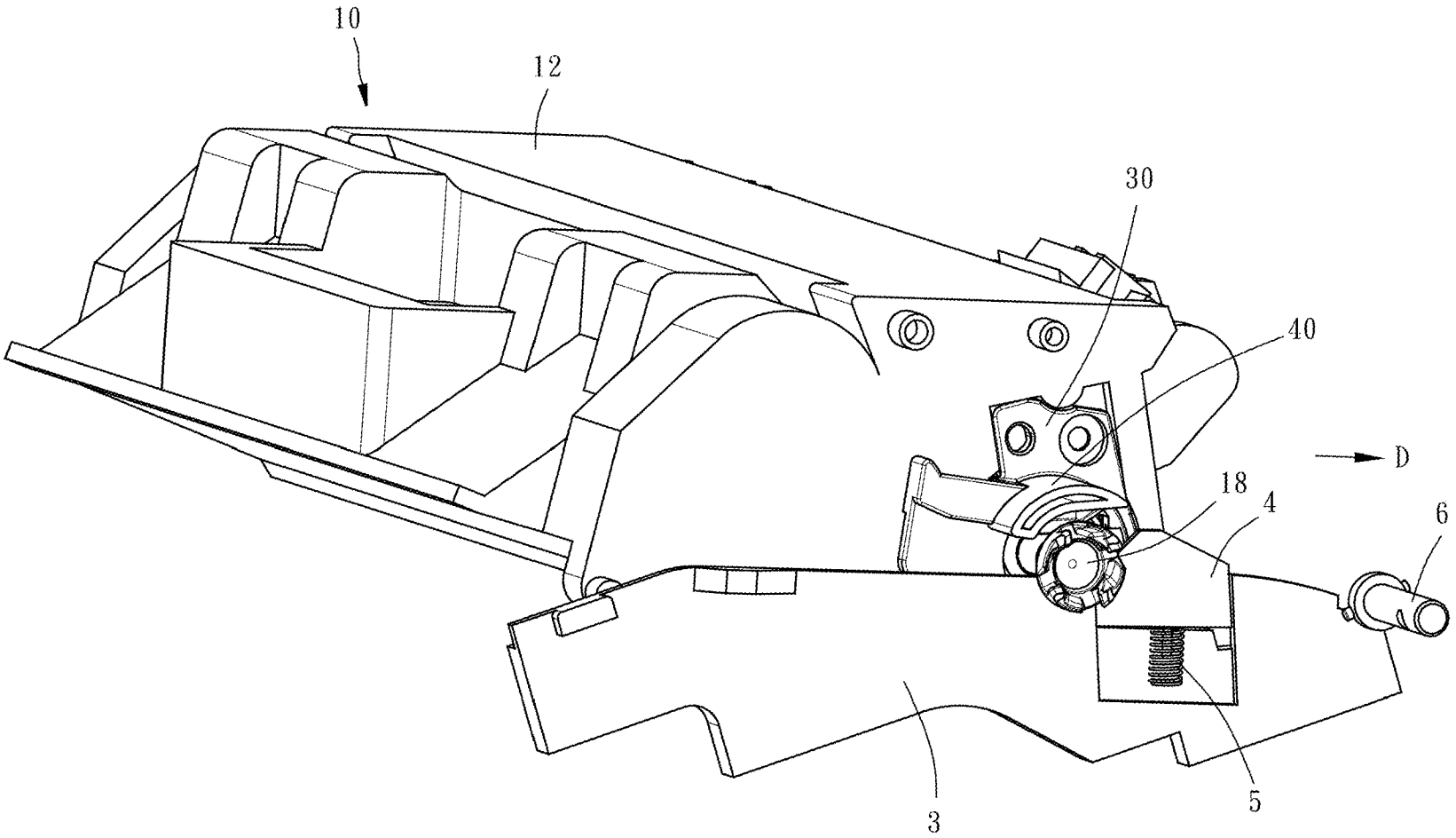
FIG. 2 is a perspective view, showing that the lateral cap of the first embodiment of the present invention is disposed to the process cartridge.
Figure 3:
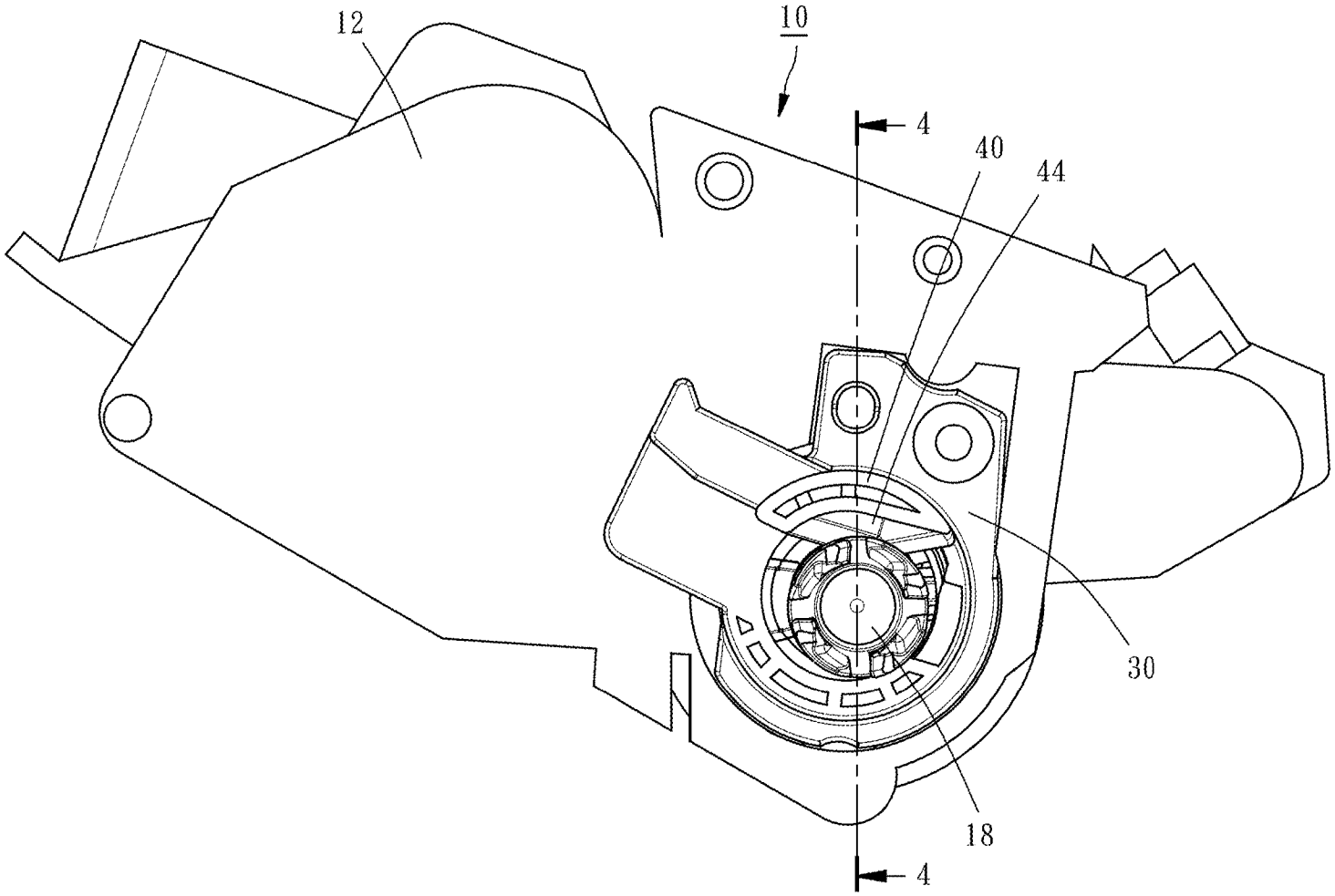
FIG. 3 is a lateral side view, showing that the lateral cap of the first embodiment of the present invention is disposed to the process cartridge.

Hereunder an embodiment will be detailedly described with accompanying drawings for illustrating technical features and structure of the present invention. As shown in FIGS. 1 and 2, a lateral cap 30 of a process cartridge 10 is provided in accordance with a first embodiment of the present invention. The process cartridge 10 is adapted to be installed into an electronic image-forming apparatus 1 along an installation direction D. Specifically speaking, a case 2 of the electronic image-forming apparatus 1 is provided at an inner wall thereof with a guiding track 3 extending along the installation direction D. At the rear section of the guiding track 3, a lifting and lowering moveable plate 4 is provided with a compression spring 5 that is disposed to a bottom of the moveable plate 4. As a result, the moveable plate 4 is pushed by the compression spring 5 and then kept at a topmost position when the moveable plate 4 receives no external force. A driving head 6 is disposed to the inner wall of the case 2 and located at a rear end of the guiding track 3.

Figure 4:
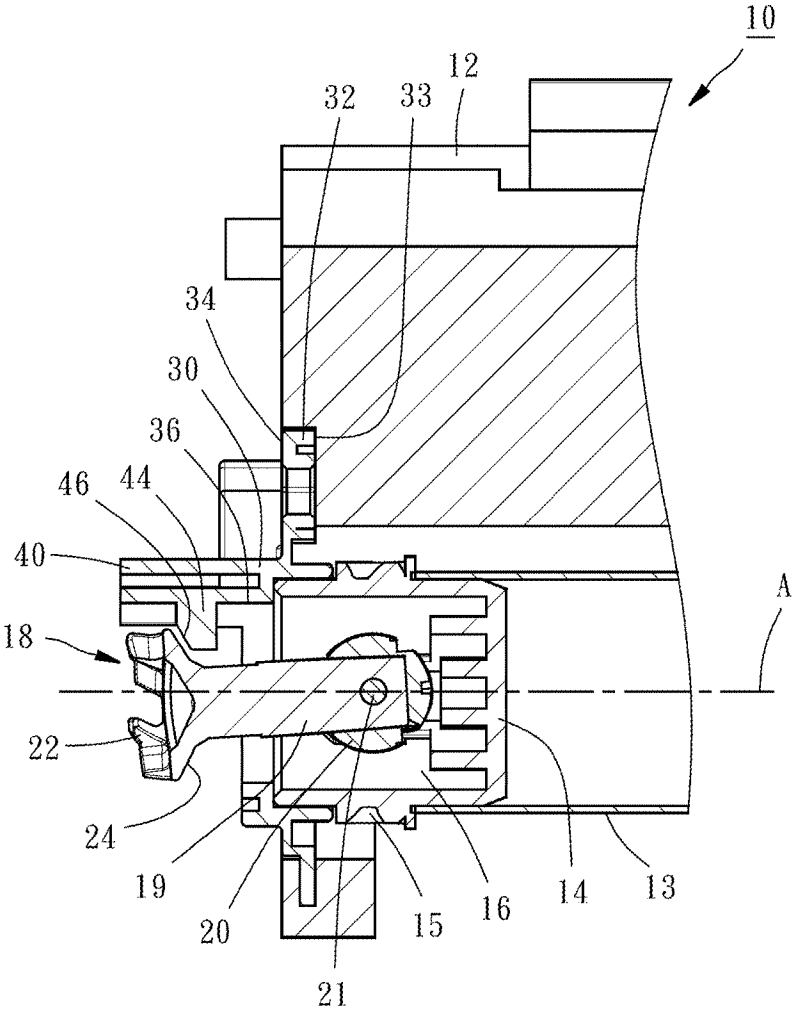
FIG. 4 is a sectional view taken along line 4-4 of FIG. 3.
Figure 5:
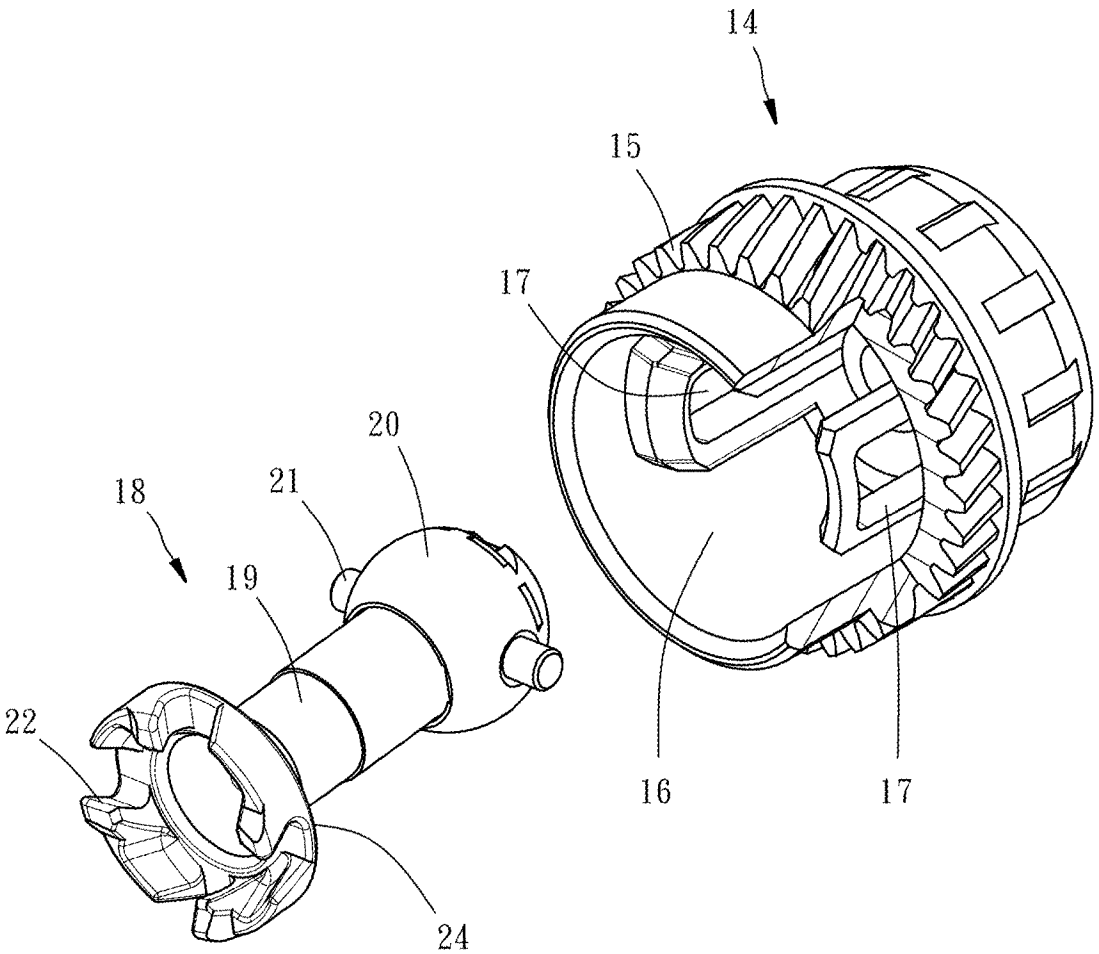
FIG. 5 is an exploded perspective view of an end member and a rotational force receiving member in accordance with the first embodiment of the present invention.
Figure 7:
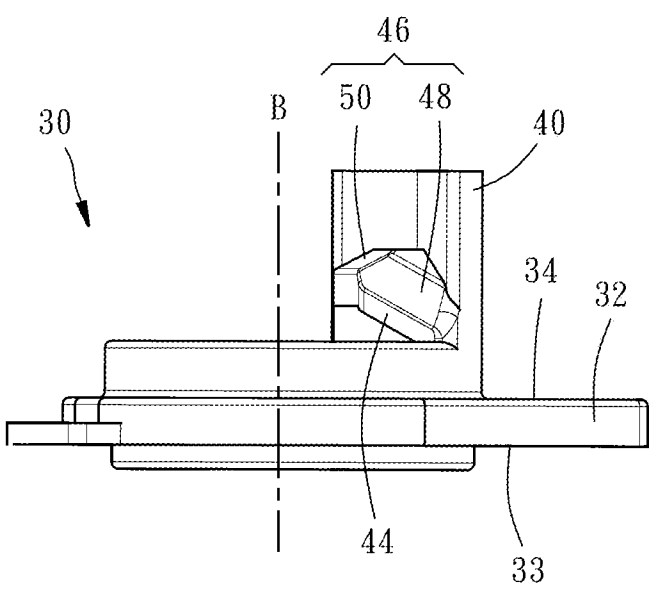
FIG. 7 is a lateral side view of the lateral cap of the first embodiment of the present invention.

Referring to FIGS. 1-4, the process cartridge 10 is composed of a housing 12, a photosensitive roller 13 rotatably disposed in the housing 12, an end member 14 disposed at an end of the roller 13 and rotatable with the roller 13, and a rotational force receiving member 18 disposed to the end member 14. The photosensitive roller 13 is defined with an axis direction A, as shown in FIG. 4. Referring to FIG. 5, the end member 14 is provided at an outer periphery thereof with a tooth portion 15, at an inside thereof with an axial hole 16, and at two lateral sides of the axial hole 16 with two sliding grooves 17. The axial hole 16 and the sliding grooves 17 extend in a direction parallel to the axis direction A. The rotational force receiving member 18 has a center axle 19 accommodated in the axle hole 16, a sphere member 20 disposed at one end of the center axle 19, and a pin 21 penetrating through the center axle 19 and the sphere member 20 in a way that that two ends of the pin 21 extend into the sidling grooves 17, respectively. In this way, the rotational force receiving member 18 is reciprocatingly moveable relative to the end member 14 along the axis direction of the through hole 16, i.e. the axis direction A of the photosensitive roller 13, and the rotational force receiving member 18 is rotatable together with the end member 14. Further, the rotational force receiving member 18 can be biased about the center of the sphere, which serves as a biasing center, at a predetermined angle relative to the axis direction A. Furthermore, as shown in FIGS. 4 and 5, the rotational force receiving member 18 is provided with an engagement head 22 at the other end of the center axle 19, and a taper portion 24 at the juncture of the engagement head 22 and the center axle 19.

As shown in FIGS. 3, 4, 6 and 7, the lateral cap 30 is composed of a main body 32, a through hole 36, a flange 40 and a guiding portion 44.

The main body 32 is shaped like a plate having a first side 33 adapted to be abutted against the housing 12, and a second surface 34 opposite to the first side 33. The first side 33 of the main body 30 is for being stopped against the end member 14, such that the end member 14 and the photosensitive roller 13 are prohibited from escape from the case 12. The shape of the main body 32 may be modified according to actual requirement. The main body 32 may be connected to the housing 12 by adhesive attachment, engagement connection, screws, etc.

As shown in FIG. 4, the through hole 36 penetrates from the first side 33 of the main body 32 through the second side 34 and communicates with an inside of the housing 12 to an outside of the housing 12. The through hole 36 is defined with an axis direction B parallel to the axis direction A of the photosensitive roller 13. The center axle 19 of the rotational force receiving member 18 extends through the through hole 36, such that the engagement head 22 of the rotational force receiving member 18 extends out of the housing 12.

The flange 40 extends from the second side 34 of the main body 30 toward a direction away from the first side 32. In this embodiment, the extending direction of the flange 40 is parallel to the axis direction B of the through hole 36. The flange 40 has substantially an arc shape and is located approximately above the engagement head 22 of the rotational force receiving member 18 for limiting the biasing angle of the rotational force receiving member 18 within a predetermined range.

Figure 6:
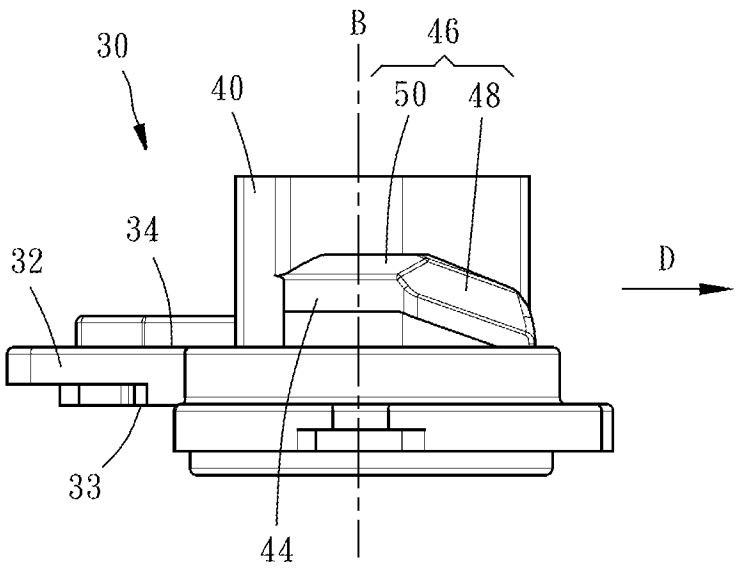
FIG. 6 is a bottom view of the lateral cap of the first embodiment of the present invention.

The guiding portion 44 extends downwardly from a meddle section of the flange 40 toward the axis direction B of the through hole 36. The guiding portion 44 has a contact surface 46 adapted to be contacted with the taper portion 24 of the rotational force receiving member 18 in a linear contact manner, which is helpful to lower the friction between the contact surface 46 and the taper portion 24. The contact surface 46 extends approaching to the first side 33 in the installation direction D, as shown in FIG. 6. That is, the right end of the contact surface 46 is closer to the first side 33 than the left end of the contact surface 46 is, as shown in FIG. 6. With this technical feature, when the rotational force receiving member 18 is biased away from the installation direction D, the rotational force receiving member 18 is contacted and pushed by the contact surface 46 to move toward a direction away from the first side 33. The shape of the guiding portion 44 may be modified with various designs. In this embodiment, the contact surface 46 is composed of an inclined portion 48 and a platform portion integrally connected with the inclined portion 48. The inclined portion 48 is a plane that extends inclinedly and gradually approaching to the first side 33 of the main body 32 in the installation direction D. That is, the right end of the inclined portion 48 is closer to the first side 33 than the left end of the inclined portion 48 is, as shown in FIG. 6. The platform portion 50 is a plane parallel to the first side 33 of the main body 32.

Figure 8:
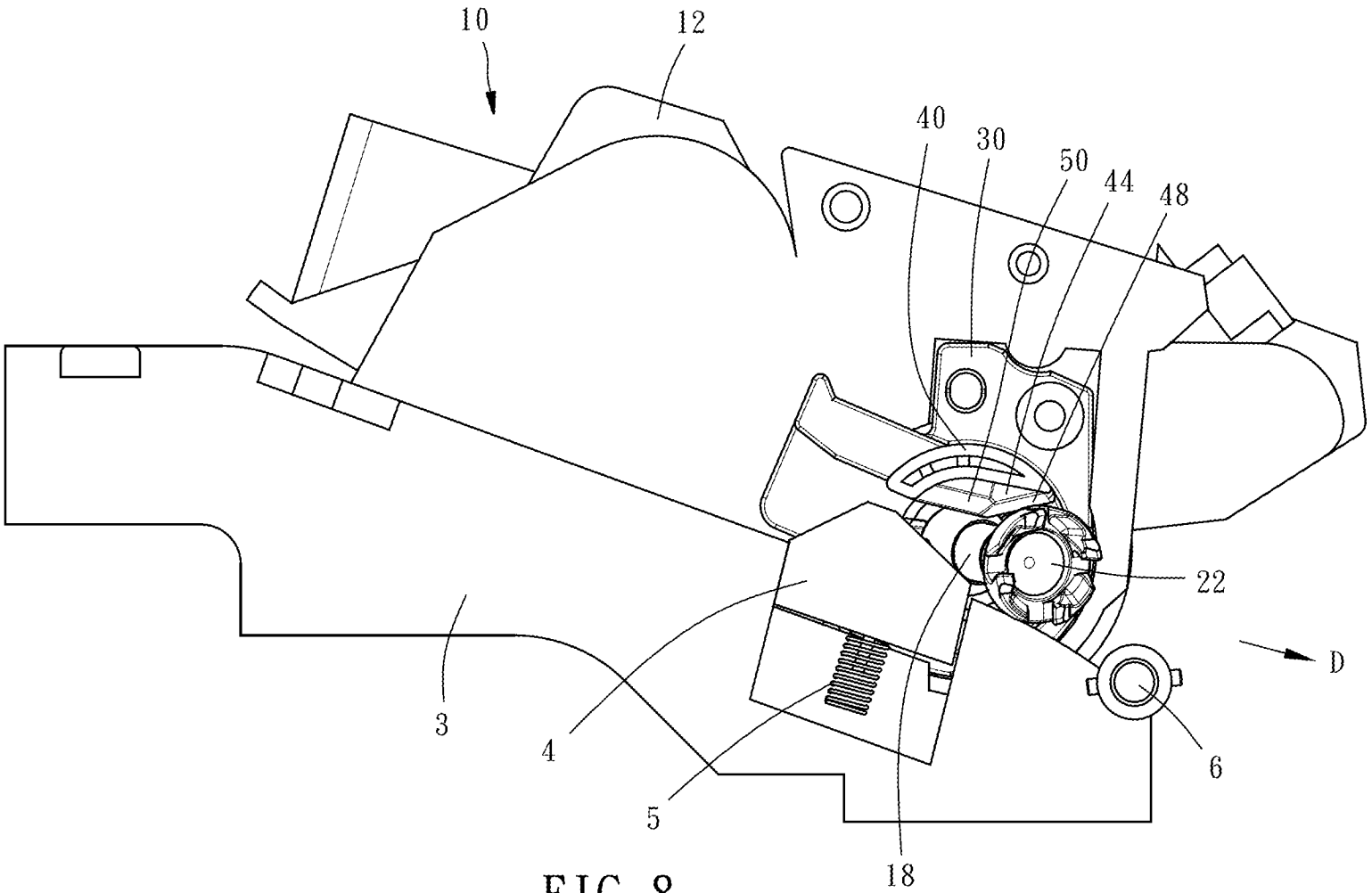
FIG. 8 is a schematic view showing the installation process of the process cartridge of the first embodiment at a stage where the rotational force receiving member is advancing to the driving head.

As shown in FIGS. 2 and 8, when a user slidingly moves the process cartridge 10 along the guiding track 3 in the installation direction D, the rotational force receiving member 18 will first contact and press the moveable plate 4 to move downwardly. And then, when the rotational force receiving member 18 continuously moves forward and passes over the rear section of the moveable plate 4, the moveable plate 4 will be pushed by the rebounding force of the compression spring 5 to move upwardly and then contact and push the center axle 19 of the rotational force receiving member 18 to force the rotational force receiving member 18 to be biased toward the driving head 6, such that the rotational force receiving member 18 reaches a ready-to-couple position where the rotational force receiving member 18 is ready to be coupled with the driving head 6.

Figure 9:
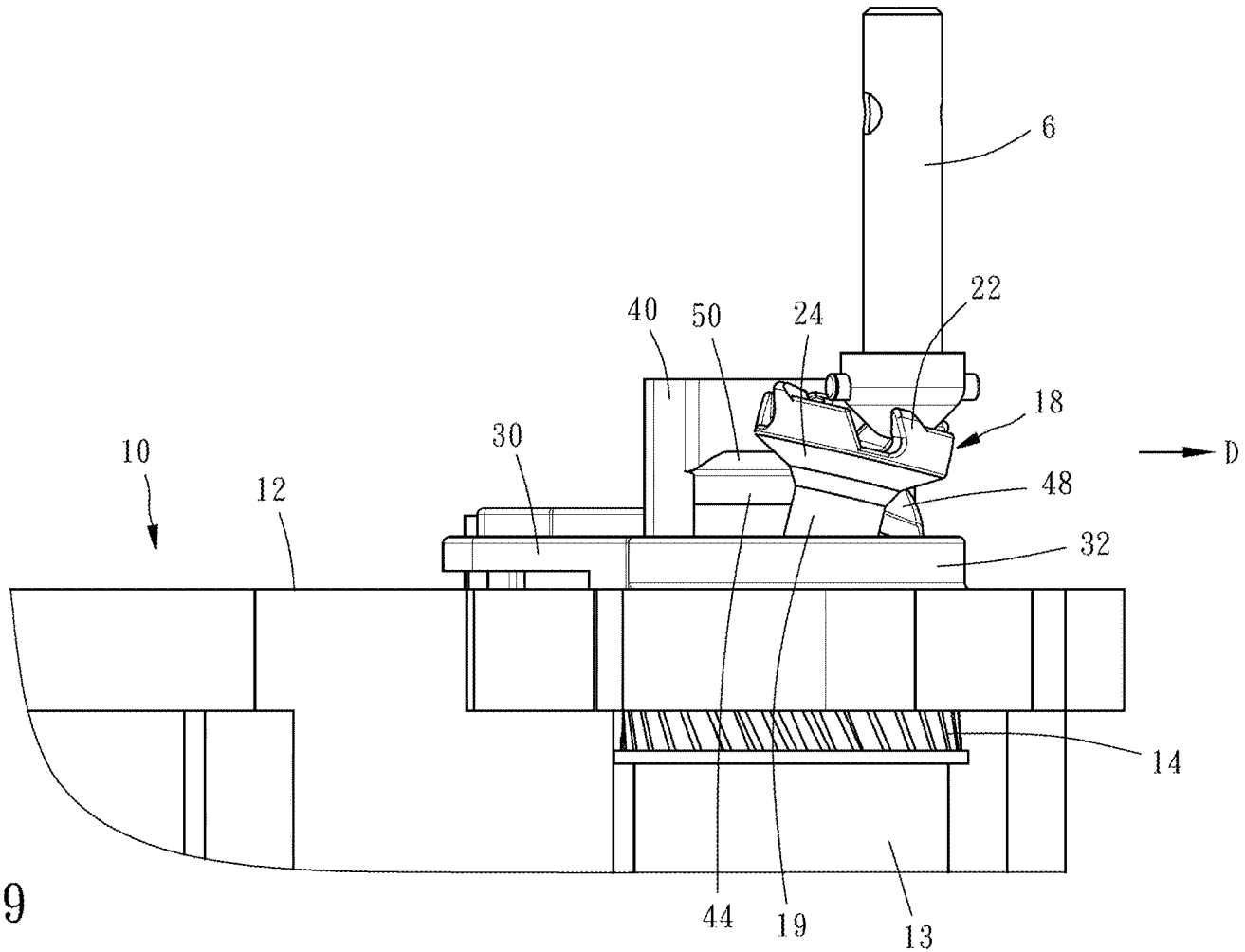
FIGS. 9 and 10 are schematic views showing the installation process of the process cartridge of the first embodiment at a stage where the rotational force receiving member is biased by the driving head.
Figure 10:
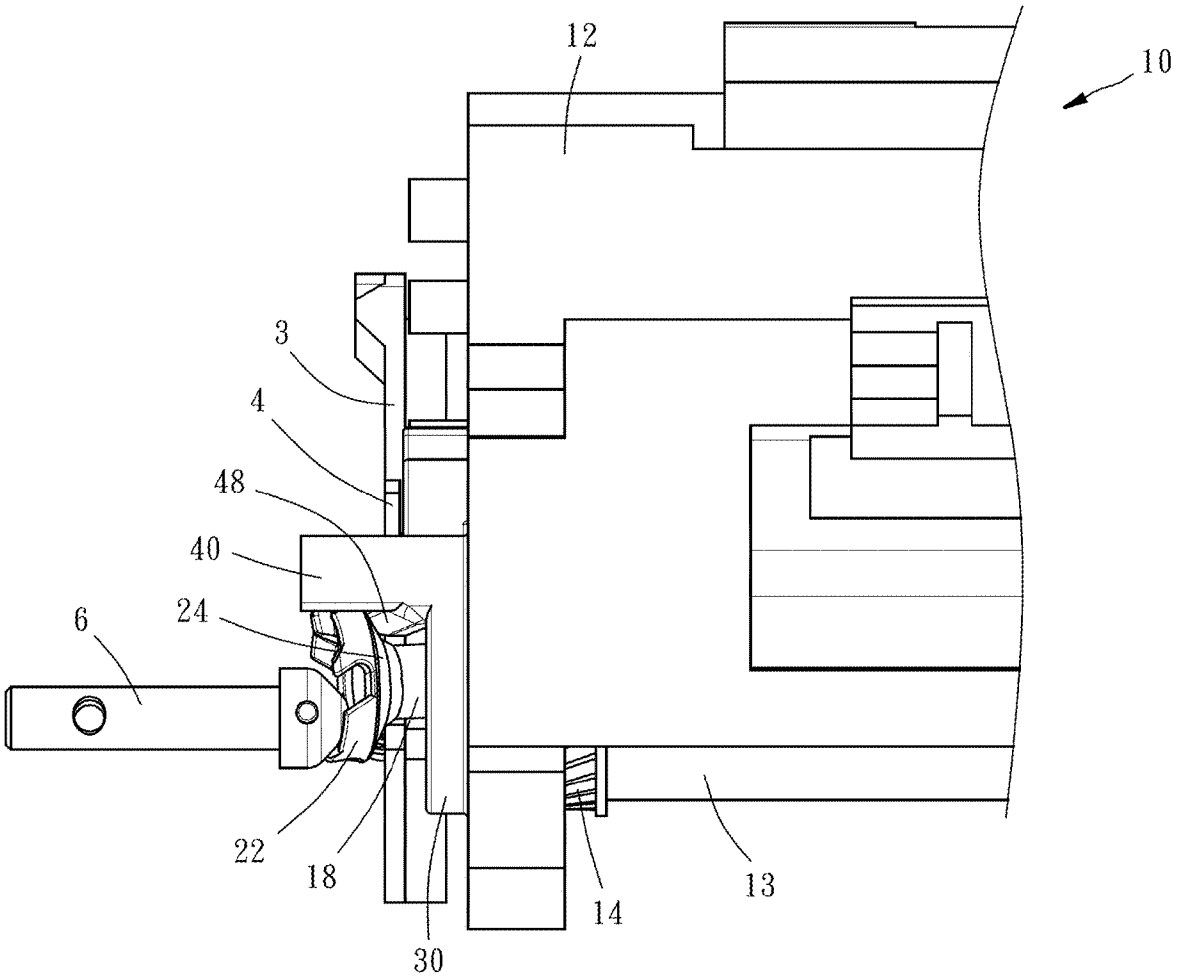

As shown in FIGS. 9 and 10, when the process cartridge 10 continuously moves forward to have the engagement head 22 of the rotational force receiving member 18 contact the driving head 6, the engagement head 22 will be driven by the driving head 6 to bring the rotational force receiving member 18 to move toward a direction reverse to the installation direction D. Because the taper portion 24 of the rotational force receiving member 18 is contacted and pushed by the inclined portion 48 of the lateral cap 30, the rotational force receiving member 18 will gradually move away from the first side 33 of the main body 32 of the lateral cap 30, i.e. gradually approach to the driving head 6.

Figure 11:
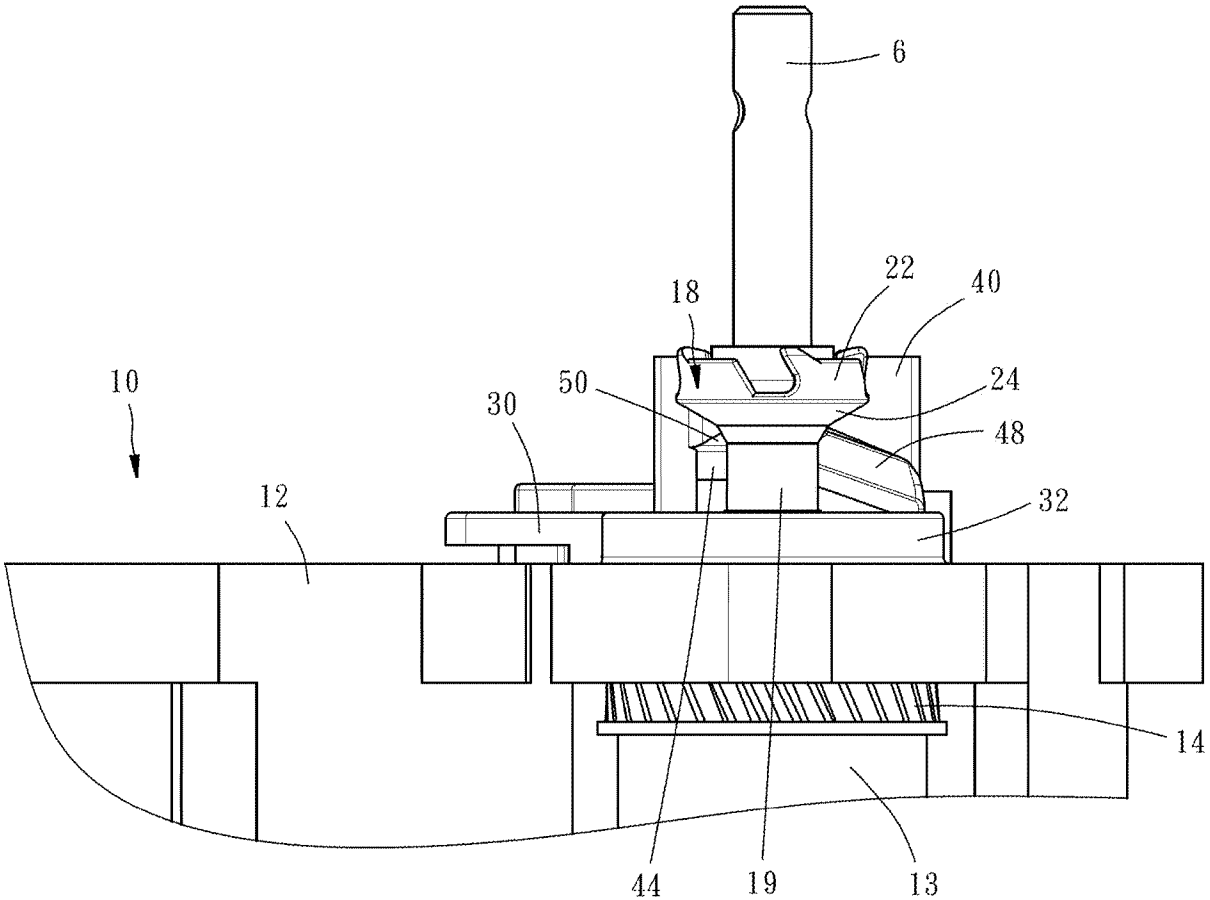
FIGS. 11 and 12 are schematic views showing the installation process of the process cartridge of the first embodiment at a stage where the rotational force receiving member is in coaxial alignment with the driving head.
Figure 12:
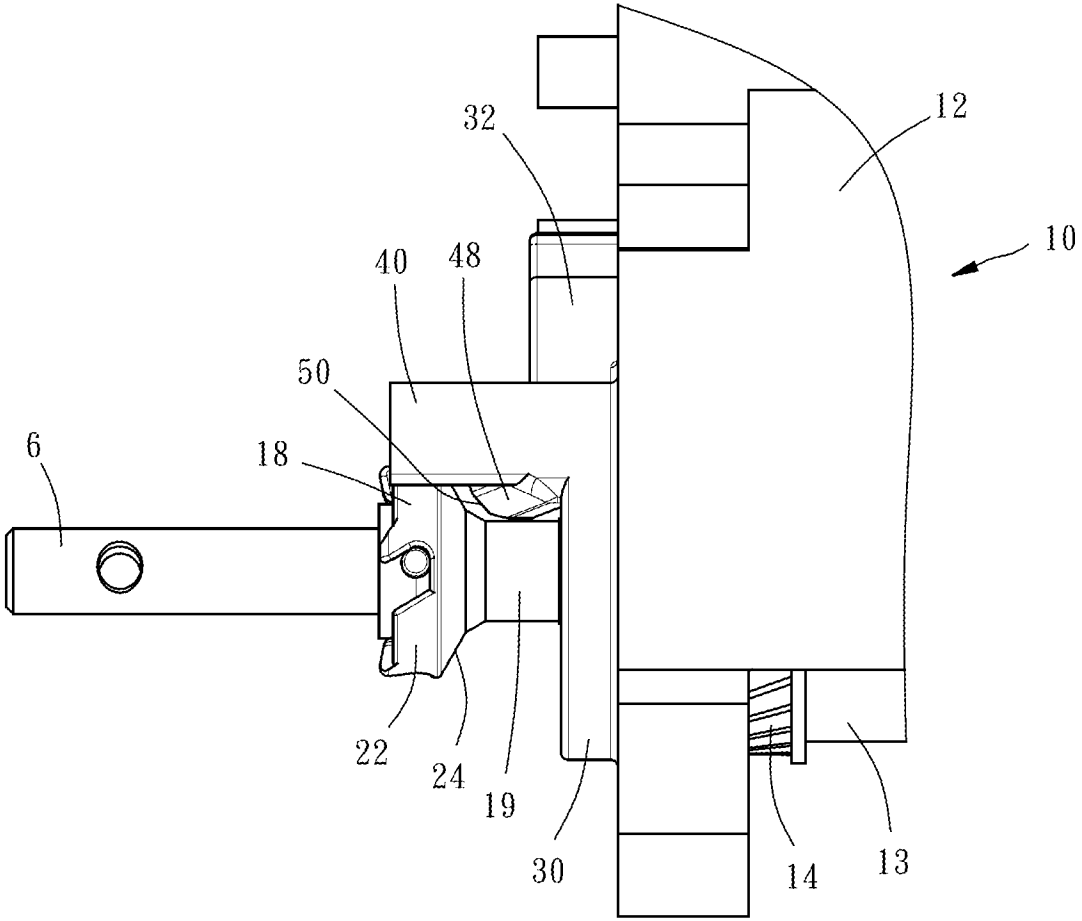

As shown in FIGS. 11 and 12, when the rotational force receiving member 18 continuously moves forward to an extent that the center axle 19 of the rotational force receiving member 18 is parallel to or coaxial with the driving head 6, the taper portion 24 of the rotational force receiving member 18 has passed over the end of the inclined portion 48 and entered the range of the platform portion 50, such that the rotational force receiving member 18 further approaches to the driving head 6 to enable the rotational force receiving member 18 and the driving head 6 to be coupled with each other. Under this circumstance, once the driving head 6 begins to rotate, the rotational force receiving member 18 will be further drawn close to the driving head 6 due to the structure of the engagement head 22, and at the meantime the taper portion 24 of the rotational force receiving member 18 is no longer associated with the platform portion 50 so as to avoid friction between the rotational force receiving member 18 and lateral cap 30 due to contact. As such, the electronic image-forming apparatus 1 can drive the photosensitive roller 13 of the process cartridge 10 to rotate via the driving head 6.

In the design of the present invention, the lateral cap 30 has a simple and compact structure and can guide the rotational force receiving member 18 to be positively positioned at a desired position. That is, the lateral cap 30 can guide the rotational force receiving member 18 to move toward the driving head 6 to have them firmly coupled with each other when the rotational force receiving member 18 is moved from a biased position to a coaxial position in alignment with the driving head 6. With the technical features of the present invention, the malfunctional rate of the installation can be minimized, such that the process cartridge 10 can be positively and successfully coupled with the electronic image-forming apparatus 1.

Based on the above-mentioned technical features, various modifications to the structure of the lateral cap 30 may be made. For example, the contact surface 46 of the guiding portion 44 may be designed with various profiles, the rotational force receiving member 18 may be provided with no such a taper portion 24, and the contact surface 46 may be configured in point contact with the rotational force receiving member 18. To ensure that the rotational force receiving member 18 and the driving head 6 can be positively coupled with each other when the rotational force receiving member 18 is biased to a coaxial position in coaxial alignment with the driving head 6, a compression spring may be provided between the end member 14 and the center axle 19 for pushing the rotational force receiving member 18 toward the driving head 6.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lateral cap of a process cartridge, which is adapted to be disposed to a housing of the process cartridge, the process cartridge being adapted to be installed into an electronic image-forming apparatus along an installation direction, the lateral cap of the process cartridge comprising:

a main body having a first side adapted to be fixed to the housing of the process cartridge, and a second side opposite to the first side;

a through hole penetrating from the first side through the second side;

a flange extending from the second side toward a direction away from the first side; and a guiding portion extending downwardly from the flange toward an axis direction of the through hole after the process cartridge is installed into the electronic image-forming apparatus;

wherein the guiding portion comprises a contact surface; the contact surface comprises an inclined portion and a platform portion connected with the inclined portion; the inclined portion approaches to the first side of the main body in the installation direction, and the platform portion is parallel to the first side of the main body.

2. The lateral cap of the process cartridge of claim 1, wherein the housing of the process cartridge is disposed at an inside thereof with a roller; the roller is provided at an end thereof with a rotational force receiving member extending through the through hole; the rotational force receiving member is pushable by the contact surface of the lateral cap to move toward the direction away from the first side.

3. The lateral cap of the process cartridge of claim 2, wherein the rotational force receiving member comprises a taper portion, which is contactable by the contact surface of the lateral cap.

4. The lateral cap of the process cartridge of claim 3, wherein the taper portion of the rotational force receiving member is in contact with the contact surface of the lateral cap.

5. The lateral cap of the process cartridge of claim 2, wherein the roller is provided at the end thereof with an end member having an axial hole and two sliding grooves at two sides of the axial hole; the rotational force receiving member comprises a center axial extending through the through hole and being accommodated in the axial hole, and a pin penetrating through the center axial in a way that two ends of the pin extend into the sidling grooves respectively, such that the rotational force receiving member is reciprocatingly moveable relative to the end member along the axis direction of the through hole and the rotational force receiving member is rotatable with the end member.

* * * * *